US006467534B1

(12) United States Patent
Klug et al.

(10) Patent No.: US 6,467,534 B1
(45) Date of Patent: Oct. 22, 2002

(54) REINFORCED CERAMIC SHELL MOLDS, AND RELATED PROCESSES

(75) Inventors: Frederic Joseph Klug, Schenectady; Michael Francis Xavier Gigliotti, Jr., Scotia, both of NY (US); Wayne David Pasco, Placitas, NM (US); Paul Steven Svec, Scotia, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/542,737

(22) Filed: Apr. 5, 2000

Related U.S. Application Data

(63) Continuation-in-part of application No. 08/944,778, filed on Oct. 6, 1997.

(51) Int. Cl.[7] ..... B22C 1/00; B22C 9/02; B22C 9/00

(52) U.S. Cl. ..... 164/517; 164/519; 164/361; 164/34; 164/529; 164/411

(58) Field of Search ..... 164/516, 517, 164/518, 519

(56) References Cited

U.S. PATENT DOCUMENTS

| | | | | | |
|---|---|---|---|---|---|
| 280,557 | A | * | 7/1883 | Bawden | 164/382 |
| 1,137,851 | A | * | 5/1915 | Fahnestock | 164/411 |
| 3,713,475 | A | * | 1/1973 | Roelofs et al. | 164/26 |
| 3,955,616 | A | | 5/1976 | Gigliotti, Jr. et al. | |
| 3,972,367 | A | | 8/1976 | Gigliotti, Jr. et al. | |
| 4,026,344 | A | | 5/1977 | Greskovich | |
| 4,316,498 | A | * | 2/1982 | Horton | 164/519 |
| 4,998,581 | A | * | 3/1991 | Lane et al. | 164/517 |
| 5,735,335 | A | * | 4/1998 | Gilmore et al. | 164/516 |
| 5,868,194 | A | * | 2/1999 | Horwood | 164/456 |

FOREIGN PATENT DOCUMENTS

| | | | |
|---|---|---|---|
| JP | 55064945 | * | 5/1980 |
| WO | 05011 A | | 2/2000 |
| WO | WO-00/05011 | * | 2/2000 |

OTHER PUBLICATIONS

Patent Abstracts of Japan, vol. 004, No. 105 (M–023), Jul. 26, 1980.
International Search Report.

* cited by examiner

*Primary Examiner*—M. Alexandra Elve
*Assistant Examiner*—Kevin McHenry
(74) *Attorney, Agent, or Firm*—Noreen C. Johnson; Christian G. Cabou

(57) ABSTRACT

A ceramic casting shell mold having a pre-selected shape comprises alternate, repeating layers of a ceramic coating material and a ceramic stucco, defining a total thickness of the shell mold; and a ceramic-based reinforcing sheet disposed in the alternate, repeating layers of coating material and stucco at an intermediate thickness. The ceramic-based reinforcing sheet comprises a one-piece monolithic, integral body, which comprises a pattern of holes that enhance bonding between the ceramic-based reinforcing sheet and adjacent ones of the alternate, repeating layers of ceramic coating material. The ceramic-based reinforcing sheet conforms to the shape of the mold and providing structural reinforcement to the mold.

20 Claims, No Drawings

REINFORCED CERAMIC SHELL MOLDS, AND RELATED PROCESSES

This application is a continuation-in-part of U.S. Ser. No. 08/944,778, filed Oct. 6, 1997, the entire contents of which are incorporated herein.

BACKGROUND OF THE INVENTION

This invention relates generally to the casting of metals. More specifically, it relates to the preparation of shell molds used in the casting of metal components.

Ceramic shell molds are used in the investment-casting of metals, to contain and shape the metal in its molten state. The strength and integrity of the mold are very important factors in ensuring that the metal part has the proper dimensions. These shell mold characteristics are especially critical for manufacturing high performance components, such as superalloy parts used in the aircraft and power generation industries.

Very high casting temperatures, such as, in the range of about 1500° C. to 1750° C., are sometimes employed. Many conventional shell molds do not exhibit sufficient strength at those temperatures. The molds become susceptible to bulging and cracking when they are filled with the molten metal. Bulging can also occur when very large parts are being cast at even lower temperatures. Bulging can alter the dimensions of the mold, thereby causing undesirable variation in the component being cast. Cracking could result in failure of the mold as the molten material runs out of it.

Greater strength is required for shell molds used at very high casting temperatures, or for those used to cast very large parts. The problem is addressed by J. Lane et al. in U.S. Pat. No. 4,998,581. In that disclosure, shell molds are strengthened by wrapping a fibrous reinforcing material around the shell mold as it is being made. In preferred embodiments, the reinforcing material is said to be an alumina-based or mullite-based ceramic composition having a specific, minimum tensile strength. The reinforcing material is apparently wrapped in spiral fashion around the shell mold with a tension sufficient to keep it in place as ceramic layers are applied to the mold to build it up to its desired thickness.

U.S. Pat. No. 4,998,581 appears to provide answers to some of the problems described above. However, there appear to be some considerable disadvantages in practicing the invention disclosed in that patent. For example, mullite-based materials are difficult to produce without second phase inclusions of either silica- or alumina-containing compounds. These inclusions can degrade the physical properties of the mold. In addition, many of the reinforcing materials employed in U.S. Pat. No. 4,998,581 have thermal expansions much less than the mold. These large thermal expansion differences will make fabrication of a crack-free mold more difficult.

Therefore, further improvements in the properties of shell would be welcome in the art. The shell molds should have the strength to withstand high metal-casting temperatures, and should be suitable for casting large parts. The molds should also be dimensionally stable at elevated temperatures, and throughout various heating/cooling cycles. Moreover, if the molds are to be improved by the use of reinforcing materials, such materials should be flexible enough, before being fired, to satisfy the shape requirements for the mold, especially when intricate metal components are being cast. Finally, the preparation of improved shell molds should be economically feasible and not require the use of a significant amount of additional equipment.

SUMMARY OF THE INVENTION

In one aspect, the invention comprises a ceramic casting shell mold having a pre-selected shape. The shell mold comprises alternate, repeating layers of a ceramic coating material and a ceramic stucco, defining a total thickness of the shell mold; and a ceramic-based reinforcing sheet disposed in the alternate, repeating layers of coating material and stucco at an intermediate thickness. The ceramic-based reinforcing sheet comprises a one-piece monolithic, integral body, which comprises a pattern of holes that enhance bonding between the ceramic-based reinforcing sheet and adjacent ones of the alternate, repeating layers of ceramic coating material. The ceramic-based reinforcing sheet conforms to the shape of the mold and providing structural reinforcement to the mold.

Another aspect of the invention provides a method for making a ceramic casting shell mold. The method comprises applying a reinforcing layer to a ceramic layer-surface of a partial shell mold that is being formed by an investment casting process; completing the shell mold by applying additional ceramic layers over the reinforcing layer; wherein the reinforcing layer comprises a pattern of holes that enhance bonding between the reinforcing layer and adjacent ones of the ceramic layer-surface and the additional ceramic layers; and firing the shell mold at an elevated temperature.

DETAILED DESCRIPTION OF THE INVENTION

In general, technology related to ceramic shell molds for investment casting is known in the art. The following texts are instructive, and their teachings are incorporated herein by reference: *Kirk-Othmer Encyclopedia of Chemical Technology,* 3rd Edition, Vol. 7, p. 798 et seq.; *Modern Metalworking*, by J. R. Walker, The Goodheart-Willcox Co., Inc., 1965; *Shell Molding and Shell Mold Castings*, by T. C. Du Mond, Reinhold Publishing Corp., 1954; and *Casting and Forming Processes in Manufacturing*, by J. S. Campbell, Jr., McGraw-Hill Book Company, Inc., 1950. The shell molds usually comprise of refractory oxide particles bonded together by a silica or phosphate gel. Various patents also describe many aspects of conventional shell-molding processes. The following are exemplary, and are all incorporated herein by reference: U.S. Pat. Nos. 4,998,581 (Lane et al.); 4,097,292 (Huseby et al.); 4,086,311 (Huseby et al.); 4,031,945 (Gigliotti, Jr. et al.); 4,026,344 (Greskovich); 3,972,367 (Gigliotti, Jr. et al.); and 3,955,616 (Gigliotti, Jr. et al.).

One investment casting technique for the present invention comprises the "lost wax" process. In a version of this technique, a wax pattern (i.e., a replica of the part being cast) is immersed repeatedly in a liquid slurry of refractory oxide particles in a silica- or phosphate-bearing binder. Usually, the slurry is highly loaded with the ceramic solids, e.g., at least about 40 volume percent, with the remainder being water, an organic solvent, or a mixture thereof. Sufficient time is provided between immersions to allow the slurry coat to partially or completely dry on the wax. After a sufficient thickness of ceramic has built up on the wax, the wax is removed by various techniques, as discussed below. The completed mold is then fired, providing it with enough strength to withstand the casting process.

In some embodiments of the invention, the wax pattern is first dipped into the slurry, and then the excess material is allowed to drain from the pattern. Before the pattern dries, it is "rained" upon with additional ceramic materials, e.g., ceramic oxides. This deposition is often carried out in a standard fluidized bed chamber, and the applied layer is sometimes referred to as a "ceramic stucco". The sequence of dipping and raining ceramic materials on the pattern is repeated until the desired thickness has been achieved. The other steps are conventional, e.g., wax removal and firing.

As mentioned previously, an aspect of the invention involves the use of a ceramic-based reinforcing sheet disposed between the layers which form the ceramic mold, at an intermediate thickness. The sheet conforms to the shape of the mold, and provides a great deal of structural reinforcement. A wide variety of ceramic materials (or mixtures of materials) may be used to form the reinforcing sheet. Many are described in one or more of the patents referenced above, e.g., materials used to form the shell mold itself. Non-limiting examples include aluminum oxide (alumina), yttrium oxide, magnesium oxide, lanthanum oxide; aluminum silicates such as mullite, kyanite, or sillimanite; and various aluminates, such as yttrium aluminate and magnesium aluminate. (The term "oxide" as used in the context above is generally meant to embrace all possible oxides of any of these materials.) Various mixtures or combinations of ceramic materials may also be used for the reinforcing sheet, e.g., two-phase mixtures based on any combination of rare earth oxides (such as lanthanum oxides), yttrium oxides, aluminum oxides, and magnesium oxides. The reinforcing layer material comprises at least one of alumina, yttrium aluminate, or mixtures thereof.

The reinforcing sheet is flexible, prior to the time when it is applied to the shell mold. This flexibility allows the sheet to be easily bent into a shape which will closely conform to the shape of the mold. The particular method for making a flexible ceramic sheet is not critical to this invention. In some embodiments, a "doctor-blade" technique, sometimes referred to as a "tape casting" technique, is useful. In this type of procedure, the appropriate ceramic powder, or mixture of powders, is first combined with a binder and an aqueous or organic solvent, to form a slurry-type pool. Suitable binders are known in the art; examples include acrylics, vinyl materials such as polyvinyl butyral, and the like. The vinyl materials and acrylics may be combined with plasticizers to provide the appropriate flexibility. The blade is moved over the surface of the pool to form a thin film which contains a controlled thickness of the slurry. After the volatile components are evaporated, such as by heating, a thin flexible, uncured or unfired ceramic sheet remains, where the sheet comprises a one-piece, integral, monolithic body, for example as produced by doctor blade and tape casting techniques. Tape casting techniques are described in various references. Non-limiting examples include U.S. Pat. Nos. 4,898,631, 4,839,121; and 5,405,571. Alternative procedures known to those skilled in the art can be used to make the reinforcing sheet. For example, a roll compaction technique could be used.

The surface of the reinforcing sheet is provided with a pattern of holes extending through the body of the sheet. The holes can be produced by punching the sheet. When present, the holes enhance bonding between the reinforcing sheet and the adjacent shell mold layers. The size of the holes can vary. The holes should not be so large that they detract from the overall strength of the sheet, nor so small that they prevent ceramic slurry material from flowing into the holes as the shell layers are being applied. The holes usually range from about 5 millimeters to about 25 millimeters in diameter. Any appropriate technique can be used to form the holes, such as use of a manual punch, drilling, laser, and the like. The holes can be made in the sheet after it has been fired, but preferably, they are formed in the sheet before firing.

Before being fired, the reinforcing sheet can be bent to a shape which is substantially identical to the shape of the shell mold. Bending green sheets made from the ceramic materials described above can be accomplished quite easily, such as, but not limited to the use of a mandrel and accompanying tools, which can measure curvature and various bending angles.

The reinforcing sheet is then fired according to conventional methods, including, but not limited to, use of an oven. A firing support of the desired shape is used during firing to ensure that the desired shape is achieved. Firing is usually carried out at a temperature of at least about 1500° C., for a time period of at least about 5 minutes, and more often, at least about 30 to about 60 minutes. After being fired, the reinforcing sheet comprises a density of at least about 90% of its theoretical density, for example, at least about 99% of its theoretical density.

Sometimes, it may be desirable to initially pre-fire the reinforcing sheet to a density of at least about 80% of its theoretical density. Final firing to one of the density levels specified above would then be carried out when the entire shell mold is fired. This alternative firing regimen would allow a shell mold manufacturer to account for differences in shrinking rates between the sheet and the mold itself.

The thickness of the reinforcing sheet will depend on a number of factors, such as the degree of reinforcement needed for the mold, which is in turn dependent on the type of casting intended for the mold. For a typical shell mold having a wall thickness of about 0.50 cm to about 2.50 cm, the reinforcing sheet will have a thickness (after firing) of about 0.1 mm to about 1.5 mm, for example, about 0.5 mm to about 1 mm. Sheets having thicknesses greater than about 1.5 mm may be difficult or impractical to manufacture, while sheets with thicknesses less than 0.1 mm may not have the strength necessary for adequate reinforcement of the mold.

As discussed above, the reinforcing sheet after firing has a tensile strength greater than the tensile strength of the shell mold itself, that is, the shell mold in the absence of the reinforcement. Moreover, the composition of the reinforcing sheet is not limited to materials which have a coefficient of thermal expansion less than the coefficient of thermal expansion of the shell mold in which it will be inserted. For instance, sheets made from alumina itself will usually have a coefficient of thermal expansion equal or greater than the coefficient of thermal expansion of the shell mold.

As discussed previously, the invention is not limited to the use of any particular investment casting technique. In embodiments, the "lost wax" process is carried out in some form. The ceramic materials used in the preparation of shell molds are similar or identical to those described for preparing the reinforcement sheet. Alumina-based materials, aluminate-based materials (such as yttrium aluminate), or mixtures of any of these materials, are often preferred. A slurry is prepared from the ceramic material and a suitable binder, such as silica or colloidal silica. The slurry may further include wetting agents, defoaming agents, or other appropriate additives, some of which are described in the referenced Greskovich patent, U.S. Pat. No. 4,026,344. Those of ordinary skill in the art are familiar with the conventional parameters which require attention when forming slurries of this type. Illustrative parameters include mixing speeds and viscosity, as well as the temperature and humidity of the mixture and of the ambient environment.

The construction of the shell mold is usually carried out by applying a layer of the slurry to the wax pattern, followed by applying a layer of a stucco aggregate, such as, made from commercially-available fused alumina, to the slurry layer, and then repeating the process a number of times. A typical chemical composition for a suitable slurry coat, after drying (and ignoring the stucco composition), includes about 80% to about 100% by weight of the alumina-based material, and about 10% to about 0% by weight of the binder material. Other components are sometimes present, such as zircon.

The number of times the layer-sequence is repeated will of course depend on the desired thickness of the mold. Usually, 4 to about 20 total ceramic slurry layer/stucco layer pairs are used for the shell mold. More often, about 4 to about 10 layer pairs are applied. At some point within the sequence of applying slurry and stucco aggregate layers, the layer-application is temporarily stopped, and the reinforcing sheet is incorporated into the partial shell mold, as discussed below.

As a more specific illustration, a wax pattern of a metal component, such as a turbine blade, can be immersed in the slurry, and then withdrawn and drained, as taught in U.S. Pat. No. 4,026,344. The wet surface of the slurry-coated pattern can then be sprinkled with the stucco aggregate in a fluidized bed, and then air-dried. The process is then repeated as many times as is necessary to produce a desired thickness of successive slurry-ceramic layers with a stucco layer in between mutually adjacent layers.

Usually, the ceramic particles in the first ceramic slurry layer/stucco layer pair, and possibly the second layer pair, have a size less than the particles in successive layers. As an example, the average ceramic particle size in the first pair of layers is preferably less than about 100 microns, while the average particle size in successive layers might be in the range of about 100 microns to about 800 microns. The larger particle size in the successive layers permits mold thickness to be increased rapidly. Larger particle sizes are also used to control the shrinkage of the mold.

After the shell mold has been completed, the wax is removed by any conventional technique. For example, flash-dewaxing can be carried out by plunging the mold into a gas-fired furnace, operating at a temperature of about 950° C. to 1150° C., for about 1 to 2 hours. The mold is then ready for firing.

The ceramic-based reinforcing sheet is incorporated into the partially-formed shell mold at a pre-selected, intermediate thickness. The exact "depth" of the sheet within the mold is dependent on various factors, such as sheet thickness, the composition of the mold layers, and the shape of the mold. Varying the position of the sheet and evaluating relevant physical properties of the mold can be used to determine the appropriate placement for the sheet. The sheet can be placed relatively close to the center of the shell mold, for example, within about 25% of the distance from the center of the wall-thickness of the mold. However, the distance may vary considerably. In most embodiments, the reinforcing sheet is incorporated after the sequence of ceramic slurry/stucco aggregate layers has been repeated about 2 to about 6 times, such as about 3 to about 5 times.

The face of the reinforcing sheet is applied against the substantially-parallel face of the outermost layer of the partial shell mold. Usually, there is some natural adherence which keeps the sheet in place while subsequent slurry/stucco layers are applied. However, an adhesive or any other attachment means could be used to keep the sheet in place. Any type of adhesive should be suitable, as long as it contains components which do not adversely affect the mold materials, or which completely vaporize when the shell mold is fired. After insertion of the reinforcing sheet, the deposition of subsequent ceramic slurry/stucco aggregate layers can be continued as before, until the appropriate mold thickness is obtained. Usually, the mold after being once fired has a wall thickness of about 0.50 cm to about 2.50 cm, for example, about 0.50 cm to about 1.25 cm.

Cores can be incorporated into shell molds being fabricated for the present invention. The cores are often used to provide holes or cavities within the mold, and they may be formed by using inserts of vitreous silica, alumina, aluminates, zircon, or any combinations of such materials, for example. The core material is removed from the final casting by conventional techniques. Many references describe the use of cores, e.g., *Modem Metalworking; Casting and Forming Processes in Manufacturing*; U.S. Pat. Nos. 4,097,292, and 4,086,311, above. The reinforcing sheet of this invention assists in maintaining the proper metal thickness around cores within the mold—especially when the mold would normally be susceptible to creep and distortion at high temperature. Precise control over the size of cavities within the mold is often critical when forming metal parts which have intricate shapes, and/or which have very rigorous dimensional requirements.

After the shell mold has been completed and the wax has been removed, the mold is fired according to conventional techniques. The required regimen of temperature and time for the firing stage will of course depend on factors such as wall thickness, mold composition, and the like. Typically, firing is carried out at a temperature in the range of about 1350° C. to about 1750° C., for about 5 minutes to about 60 minutes. The mold is then allowed to cool to room temperature. Further steps which are conventional to mold fabrication may also be undertaken, e.g., repairing and smoothing the surfaces of the mold.

The use of shell molds like those of the present invention for casting is also familiar to those skilled in the art. A wide variety of metals or metal alloys may be cast, such as titanium and nickel-based superalloys. Thus, components made from such materials with the reinforced shell mold are also within the scope of this invention.

EXAMPLES

These examples are merely illustrative, and should not be construed to be any sort of limitation on the scope of the invention. All parts are provided in weight percent, unless otherwise indicated, and values are approximate, unless otherwise indicated.

Example 1

Sample molds were prepared, using conventional shell mold technology. The steps were as follows (with mold reinforcement being carried out within the sequence of steps, as described below):

(1) A wax pattern is dipped into a suspension of −325 mesh tabular alumina and silica binder;

(2) The coated pattern is drained;

(3) The coated pattern is then dipped into a fluidized bed of 80-grit fused alumina;

(4) The pattern is air-dried;

(5) Steps 1–4 are repeated;

(6) The pattern is dipped into a suspension of −240 mesh and −325 mesh alumina, with a silica binder;

(7) The pattern is dipped into a fluidized bed of −54 mesh alumina;

(8) The pattern is then air-dried; and (9) Steps 6–8 are repeated six times.

For the purpose of this description, the "primary coat" is defined as the first two layers applied in steps 1–4, while the "secondary coats" are defined as the layers applied in steps 6–9. Rectangular wax patterns were used to prepare the molds. After fabrication, two opposing walls of the mold were scraped away to leave two flat bars. The bars (20 cm long and 2.5 cm wide) were then fired at 1000° C. in air, to develop additional handling strength. The molds were then fired at a temperature in a range from 1500° C. to 1550° C., prior to evaluation. The bars were uncracked after being fired.

Mold reinforcement according to the present invention was accomplished by incorporating a dense alumina-based sheet into the mold. Perforated sheets were made by punching 0.48 cm holes on 0.89 cm-centers in the unfired sheet. The alumina sheet was then fired at 1600° C. for 1 hour, to yield densities greater than about 99%. The sheet was applied to the mold surface between the second and third secondary slurry coats, using a mixture of −240 mesh alumina and potassium silicate paste. Subsequent secondary coats were then applied, burying the sheet in the interior of the mold wall.

For testing purposes, bars were machined from both the reinforced molds and the unreinforced molds, after the molds had been sintered. Only the exterior of the mold was machined, to provide a thickness of 0.79 cm. The width of the bars after machining was 1.59 cm. The primary coats were left intact during the machining operation.

A 3 point sag test on a 15.24-cm span was performed on each bar at 1550° C. For this test, a load of about 50 psi (0.34 MPa) was applied in the center of each span. The deflection of each bar after testing is shown in Table 1:

TABLE 1

| | |
|---|---|
| Unreinforced bar | 0.5 mm |
| Unreinforced bar | 0.6 mm |
| Reinforced bar* | .05 mm |

*Reinforced with an alumina-based sheet, according to the present invention.

Table 1 clearly demonstrates the dramatic improvement in strength for shell molds reinforced according to the present invention.

Example 2

A mixture of wax and 120-mesh fused alumina was combined (with the wax being melted) to form a ceramic slurry. The slurry was cast on a form with a surface curvature typical of a turbine bucket, and then allowed to solidify. The cast block was removed from the casting form. The block was then fired at 1500° C. to remove the wax, and to develop handling strength. The cast block was next used as a firing support for a flexible sheet of alumina. The sheet was deformed by hand to conform to the curvature of the firing support. The firing support with the alumina sheet was then fired at 1600° C. for 1 hour in air. The product obtained after firing was a dense, curved sheet of alumina with the contours of a turbine bucket. Such a sheet can be used as reinforcement for the shell mold described in Example 1. Moreover, the sheet has been made by a technique which does not require elaborate equipment, e.g., a fiber-wrapping apparatus.

While embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present invention.

What is claimed is:

1. A ceramic casting shell mold having a pre-selected shape, and comprising:

(a) repeating layers of a ceramic material where a first layer of said ceramic coating comprises ceramic particles having an average particle size less than about 100 microns and where the average particle size of successive layers is between about 100 microns to about 800 microns; and (b) a flexible ceramic-based reinforcing sheet disposed in the repeating layers of the ceramic material at an intermediate thickness, the ceramic-based reinforcing sheet comprises a one-piece monolithic, integral body that comprises a thickness in a range from about 0.1 mm to about 1.5 mm and a pattern of holes extending through the sheet that enhance bonding between the ceramic-based reinforcing sheet and layers of ceramic material, the ceramic-based reinforcing sheet conforming to the shape of the mold and providing structural reinforcement to the mold.

2. The shell mold of claim 1, wherein the ceramic-based reinforcing sheet comprises at least one of alumina-based compounds, aluminate-based compounds, or mixtures of any of the foregoing compounds.

3. The shell mold of claim 1, wherein the ceramic-based reinforcing sheet comprises a tensile strength that is greater than that of the shell mold itself, in the absence of the ceramic-based reinforcing sheet.

4. The shell mold of claim 1, wherein the ceramic-based reinforcing sheet is disposed at an intermediate thickness of about 2 to about 6 of the repeating layers.

5. The shell mold of claim 1, wherein the ceramic-based reinforcing sheet is disposed at an intermediate thickness of about 3 to about 5 of the repeating layers.

6. The shell mold of claim 1, wherein the ceramic-based reinforcing sheet comprises a density of at least about 90% of its theoretical density.

7. The shell mold of claim 6, wherein the ceramic-based reinforcing sheet comprises a density of at least about 99% of its theoretical density.

8. The shell mold of claim 6, wherein the ceramic-based reinforcing sheet is prepared by a doctor blade technique or a roll compaction technique, followed by a firing treatment.

9. The shell mold of claim 6, wherein the ceramic-based reinforcing sheet comprises a thickness in a range of about 0.5 mm to about 1.0 mm.

10. The shell mold of claim 6, wherein the ceramic-based reinforcing sheet comprises at least one of alumina, yttrium aluminate, or mixtures thereof.

11. The shell mold of claim 1, the shell mold comprising a wall thickness in a range from about 0.50 cm to about 2.50 cm.

12. A method of making a ceramic investment casting shell mold, the method comprising:

(i) preparing a slurry of a ceramic material;

(ii) applying a layer of the ceramic slurry to a wax pattern of a pre-selected shape of a metal to be cast into the mold, where the first layer of said ceramic slurry comprises ceramic particles having an average particle size less than about 100 microns;

(iii) applying a layer of a ceramic-based stucco aggregate on the layer of the slurry;

(iii) repeating steps (i) and (ii) as often as necessary to provide a partial shell mold having a pre-selected, intermediate thickness, where the average particle size of successive ceramic layers is between about 100 microns to about 800 microns;

(iv) applying a flexible reinforcing sheet which substantially conforms to the exterior surface of the partial shell mold; the reinforcing sheet comprising a one-piece, monolithic body with a density of at least about 90% of its theoretical density;

(v) building up the partial shell mold to the desired thickness of a full shell mold by repeating steps (ii) and (iii) over the reinforcing sheet; wherein the sheet comprises a pattern of holes extending through the sheet that enhance bonding between adjacent ones of the layers of ceramic slurry and layers of ceramic-based stucco aggregate; and (vi) removing the wax and firing the shell mold to provide it with a desired level of tensile strength.

13. The method of claim 12, wherein the reinforcing sheet comprises at least one of alumina-based compounds, aluminate-based compounds, or mixtures thereof.

14. The method of claim 13, wherein the reinforcing sheet comprise at least one of alumina, yttrium aluminate, and mixtures thereof.

15. The method of claim 12, wherein the reinforcing sheet is flexible before being fired and applied to the partial shell mold.

16. The method of claim 15, wherein the reinforcing sheet is shaped to a geometry substantially identical to that of the partial shell mold surface, prior to being fired.

17. The method of claim 12, wherein the reinforcing sheet is applied in step (v) after steps (ii) and (iii) have been repeated for about 2 to 6 times.

18. The method of claim 12, wherein the sheet is fired prior to its application to the partial mold surface, according to a time and temperature schedule to provide a desired sheet density.

19. A shell mold prepared by the method of claim 12.

20. A ceramic casting shell mold having a pre-selected shape, and comprising:

(a) repeating layers of a ceramic material where a first layer of said ceramic coating comprises ceramic particles having an average particle size less than about 100 microns and where the average particle size of successive layers is between about 100 microns to about 800 microns; and (b) a flexible ceramic-based reinforcing sheet disposed in the repeating layers of the ceramic material at an intermediate thickness, the ceramic-based reinforcing sheet comprises a one-piece monolithic, integral body that comprises a density of at least about 90% of its theoretical density and a pattern of holes extending through the sheet that enhance bonding between the ceramic-based reinforcing sheet and layers of ceramic material, the ceramic-based reinforcing sheet conforming to the shape of the mold and providing structural reinforcement to the mold.

* * * * *